US006554924B2

(12) United States Patent
Morrow et al.

(10) Patent No.: US 6,554,924 B2
(45) Date of Patent: Apr. 29, 2003

(54) METALLIC DIFFUSION PROCESS AND IMPROVED ARTICLE PRODUCED THEREBY

(75) Inventors: M. Stanley Morrow, Kingston, TN (US); Donald E. Schechter, Ten Mile, TN (US); Harley A. Grant, Harrison, TN (US)

(73) Assignee: BWXT Y-12 LLC, Oak Ridge, TN (US)

( * ) Notice: Subject to any disclaimer, the term of this patent is extended or adjusted under 35 U.S.C. 154(b) by 0 days.

(21) Appl. No.: 09/764,925

(22) Filed: Jan. 18, 2001

(65) Prior Publication Data

US 2002/0092587 A1 Jul. 18, 2002

(51) Int. Cl.[7] ..... C21D 1/09
(52) U.S. Cl. ..... 148/565; 148/525
(58) Field of Search ..... 148/565, 525

(56) References Cited

U.S. PATENT DOCUMENTS

| | | | | |
|---|---|---|---|---|
| 3,764,373 A | | 10/1973 | Speirs et al. | 117/107.2 |
| 3,867,184 A | | 2/1975 | Baldi et al. | 117/107.2 |
| 3,958,046 A | | 5/1976 | Baldi | 427/252 |
| 4,041,196 A | * | 8/1977 | Baldi et al. | 118/717 |
| 5,397,530 A | * | 3/1995 | Narasimhan et al. | 419/1 |
| 6,183,689 B1 | | 2/2001 | Roy et al. | |

* cited by examiner

*Primary Examiner*—Roy King
*Assistant Examiner*—Andrew Wessman
(74) *Attorney, Agent, or Firm*—J. Herbert O'Toole; Nexsen Preut Jacobs & Pollard, LLC

(57) ABSTRACT

A uniquely surface-modified metallic part is provided by the utilization of microwave energy to promote diffusion of desired metals into the surface of the formed metallic part.

11 Claims, 3 Drawing Sheets

METALLIC DIFFUSION PROCESS AND IMPROVED ARTICLE PRODUCED THEREBY

The U.S. Government has rights in this invention pursuant to contract No. DE-AC05-000R22800 between the Department of Energy and BWXY Y-12 LLC, and contract No. DE-ACO5-84OR21400 between the Department of Energy and Lockheed Martin Energy Research Corporation.

FIELD OF THE INVENTION

This invention relates generally to the art of alloys, and more particularly, to the art of diffusion modification of surface areas formed with metallic parts.

BACKGROUND OF THE INVENTION

Metallic components have conventionally been modified over the course of prior art to provide superior characteristics on the surface areas thereof while the internal areas are substantially unaffected. Examples of such processes include galvanizing wherein metallic components are coated with zinc or other alloys to enhance resistance to surrounding environments. Another example of such prior art techniques involves the treatment of aluminum by an anodizing technique to form a thin layer of oxide, and to also provide enhanced resistance to surrounding environments.

More sophisticated techniques have involved the diffusion of various metallic substances into the surface of formed metallic parts. Traditionally, this has been carried out within heated environments utilizing various heating elements where entire environments are heated to a temperature sufficient to effect diffusion of metals into formed metallic parts. One such process is the retort method wherein a metallic part is welded within a retort contained in the metallic substance to be diffused into the surface thereof. Generally, this involves a slow heating to approximately 2100° F., followed by a long, slow cooling. Techniques known as the pack method and blanker method are similar, but also require long heating and cool down periods with substantial volumes of material, including the part and metallic substance effecting the change in the part. Normally such techniques involving the slow heating and cooling bring about substantial changes, not only in the surface of the metallic parts, but the inner volume areas where grain growth and refinement take place as a natural consequence of such heating.

SUMMARY OF THE INVENTION

It is thus an object of this invention to provide an improved process for surface modification of formed metallic parts.

It is a further object of this invention to modify the surface of formed metallic parts by diffusion of metals which will provide improved corrosion resistance and improved resistance to physical wear and abrasion.

It is a further object of this invention to provide such modification by an improved process which does not result in substantial grain growth or refining of the interior volume of such formed metallic parts.

It is a further and yet more particular object of this invention to provide such an improved process which has a time cycle substantially less than that encountered in the prior art.

These as well as other objects are accomplished by a process for diffusing metal into the surface of a formed metallic part by surrounding said formed metallic part within an environment of an insulator material having a desired metal dispersed therein. Microwaves are directed to the environment to heat the formed metallic part and the surrounding environment to a temperature sufficient to cause diffusion of the desired metal into surface portions of the desired part.

DETAILED DESCRIPTION

Figure 1:
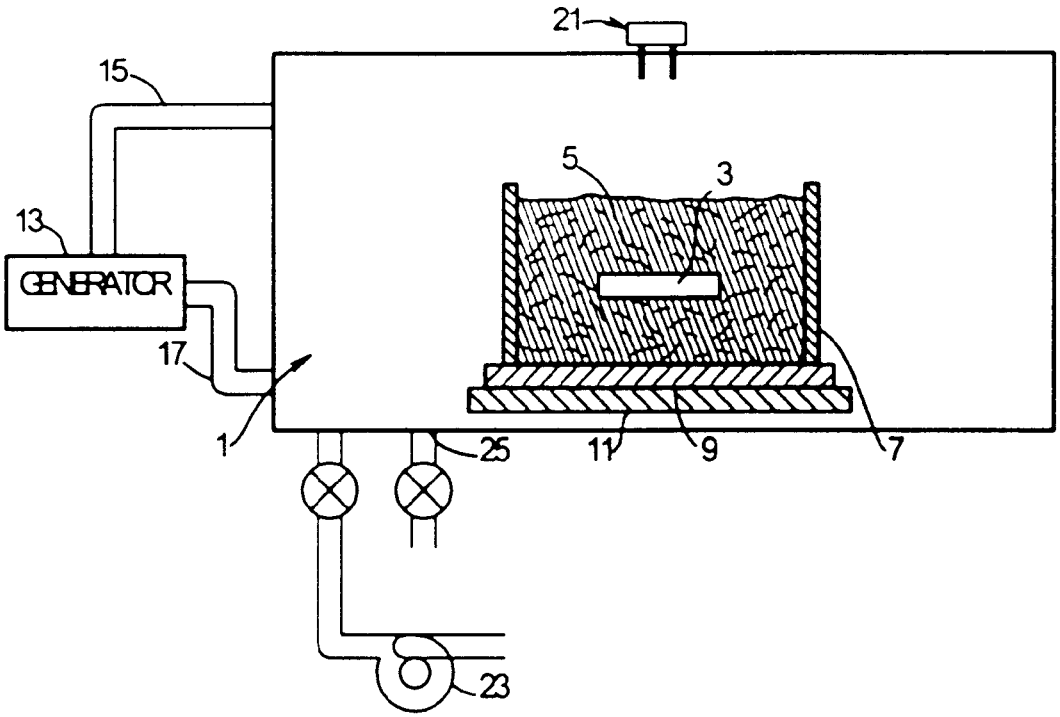
FIG. 1 is a schematic illustration of an apparatus for carrying out the process of this invention.
Figure 2:
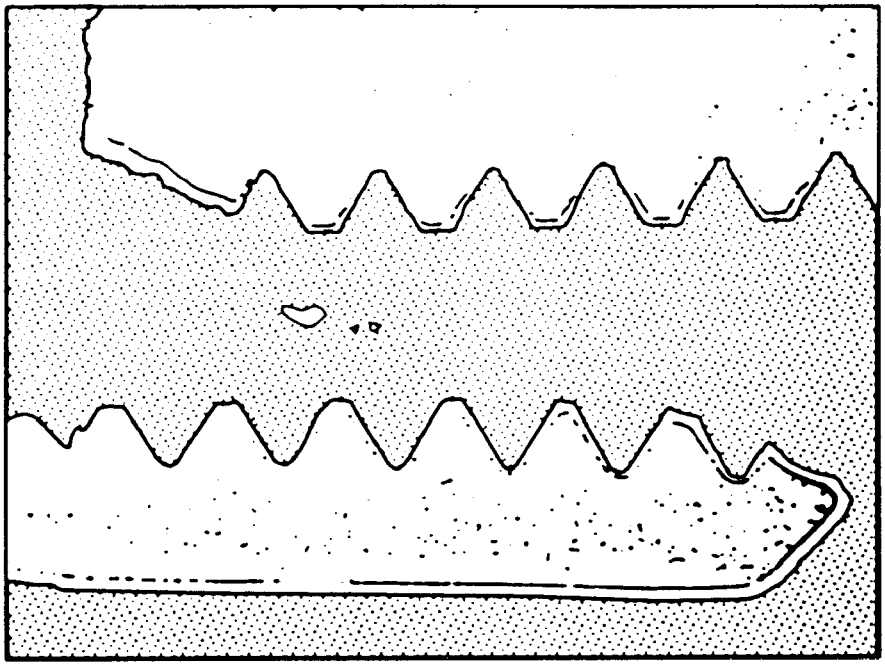
FIGS. 2 through 5 are photomicrographs demonstrating various examples of this invention.
Figure 3:
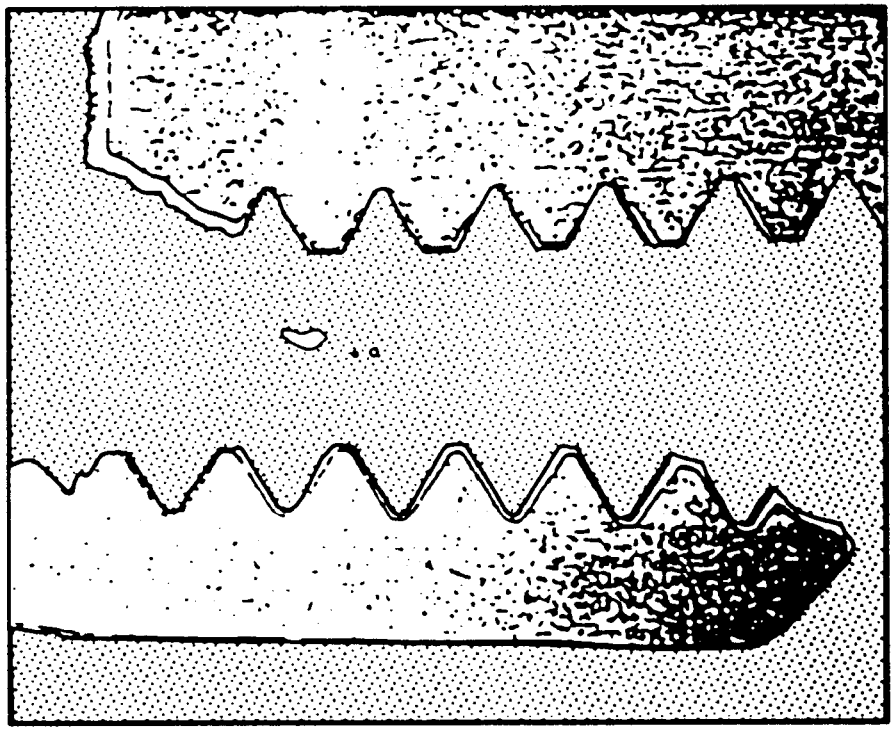
Figure 4:
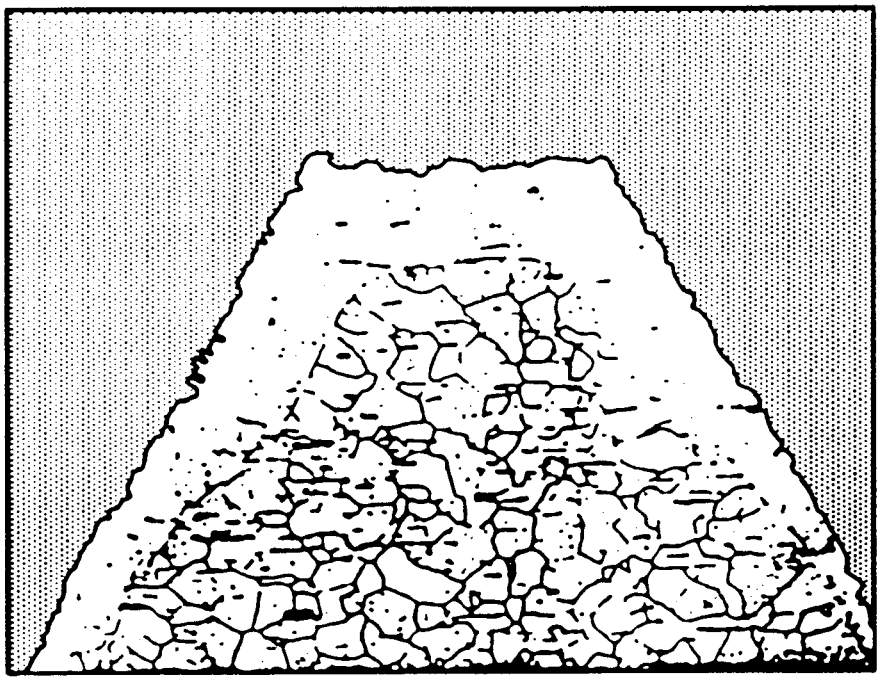
Figure 5:
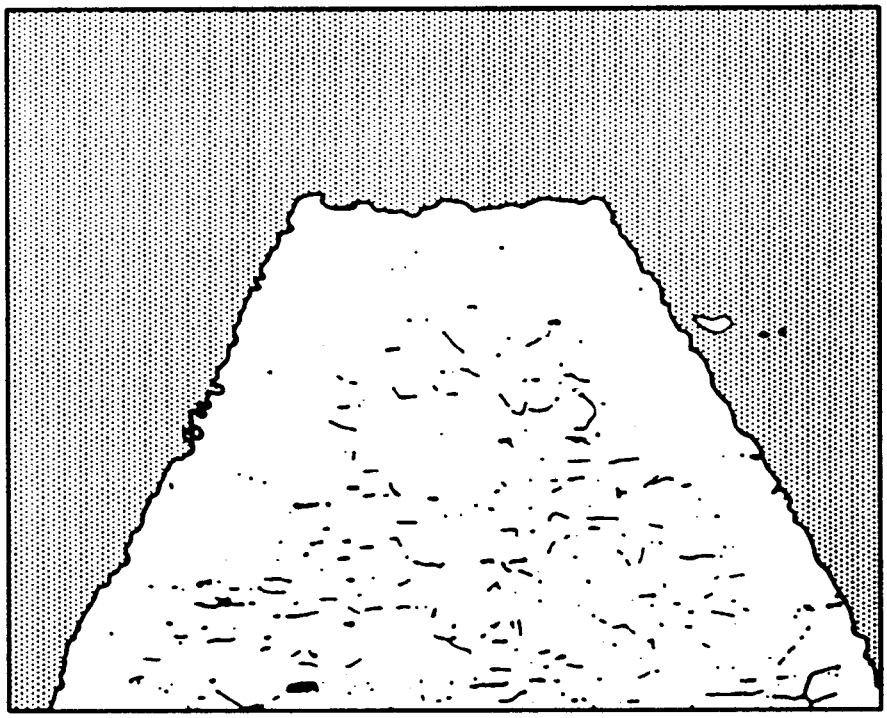

In accordance with this invention it has been found that microwave energy may be utilized to bring about the diffusion process of desired metals into the surface area of formed metallic parts. This has substantial advantages over the prior art. Heating and cooling cycles are substantially shorter, resulting in minimal grain growth and grain refinement within the volume of the formed metallic part. There are also virtually no dimensional changes in the part brought about as a result of the diffusion process of this invention. The process of this invention may be used to bring about a variety of surface enhancements, including corrosion resistance, and visual appearance, as well as environment specific resistance. Such process has substantial utilization in the boiler and automotive parts industries. Various other advantages and features will become apparent from the following description given with reference to the various figures of drawing.

The process of this invention involves enhancement of the properties of formed metallic parts. Such formed metallic parts may be from a variety of steels, including those which have been previously corroded. Preferably, the formed metallic part is a carbon steel and it has generally been found that a variety of desired metals may be diffused into the surface of formed metallic parts to bring about corrosion resistance appearance enhancement, as well as specific resistance to a variety of environments. Generally, the formed metallic part is surrounded by an insulating material having the desired metal or metals therein and then subjecting the formed metallic part and its surrounding environment including the desired metals to microwave energy to heat the part and the environment to a temperature sufficient for diffusion of the designed metals into the surface areas for the formed part to occur. This is preferably carried out by casketing the formed part in an insulator and metal environment within the cavity of a microwave generating oven. The process may be applied selectively by surrounding only those surface areas of the formed metallic part where diffusion is desired with an environment which is rich in the metal to be diffused into the part. In such a selective process only those portions of the formed metallic part that are in contact with the rich areas of desired metal will undergo surface diffusion.

Temperatures of 2100° F. are quickly achieved so that only the surface areas of the formed metallic part are affected, frequently without significant heating of the volume of the formed metallic part. The insulated material may be any ceramic material which is not significantly affected by microwave sources. Generally aluminum oxide powder is desirable for such affect. Amongst the metals which may be utilized in the diffusion process are chromium, nickel, vanadium, boron, aluminum, iron and alloys and mixtures thereof. Because the heating process utilizing microwaves does not have the long heat-up and cool-down times of the prior art, the formed metallic part having been surface-modified by the diffusion process of this invention is unique because its grain structure is not effected by the heating process. Accordingly, the product produced by this invention is unique in and of itself.

The process utilizes an activator mixed with the insulator. A preferred activator is ammonium chloride ($NH_4Cl$) although other halides or chlorides will work. The activator acts as a getter to remove oxygen and initiate the formation of chromous halides.

An environment suitable for treating carbon steel in accordance with this invention is one which contains by weight 30–45% chromium, 2–10% chloride (activator) with the balance being aluminum oxide powder. If elemental chromium is used 20–35% by weight will suffice with 30% being optimal.

FIG. 1 of the drawings depicts an environment for carrying out the process in accordance with this invention. The microwave cavity 1 is illustrated having therein a formed metallic part 3 surrounded by an environment 5 of insulating materials such as aluminum oxide containing a desired metal for diffusion into the formed metallic part 3. A container 7, referred to as a casket in the art, contains the environment 5 and formed metallic part 3. Casket 7 rests upon an insulator plate 9, which in turn rests upon a table 11 positioned for insertion and removal from the microwave cavity 1. A microwave generator 13, with associated wave guides 15 and 17, provides the microwave energy to the cavity 1. A site-port 21 is provided for temperature measurement by optical measuring means such as an optical pyrometer. The microwave cavity 1 may be evacuated by pump 23 and the environment appropriately filled with an inert gas through a port 25 if so desired.

FIGS. 2 through 5 are 10X photomicrographs of the cross section of a part which was treated using the disclosed process. Several carbon steel stove bolts and nuts were embedded in a granular mixture consisting of approximately 55% $A1_2O_3$, 42% FeCr, and 3% $NH_4Cl$ by weight. The mixture was housed in a boron nitride crucible. The crucible, granular mixture and nuts and bolts were placed in a 2.45 Ghz microwave oven and approximately 1 kW of power was applied for approximately 30 minutes. This process diffused chromium into the surface of the carbon steel as illustrated in FIGS. 2 through 5.

It is thus seen that the process of this invention provides a uniquely modified formed part by utilization of microwaves to bring about diffusion into the surface thereof. These and other advantages and features will become apparent from a reading of the above description which is exemplary in nature. Such modifications are embodied within the spirit and scope of this invention as defined by the following appended claims.

What is claimed is:

1. A process for diffusing metal into the surface of a formed metal part comprising the steps of:

positioning said formed metal part within an insulator material having a diffusion metal dispersed therein, directing microwaves to said insulator material to a temperature sufficient to cause diffusion of said diffusion metal into surface portions of said formed metal part to bring about changes in the characteristics thereof.

2. The process according to claim 1 wherein said formed metal part is casketed within a container holding said insulator material and said diffusion metal.

3. The process according to claim 1 wherein said diffusion metal is selected from the group consisting of chromium, aluminum, nickel, vanadium, boron, iron and alloys and mixtures thereof.

4. The process according to claim 1 wherein said formed metal part is carbon steel.

5. The process according to claim 1 wherein said insulator material is mixed with a halide activator.

6. The process according to claim 5 wherein said halide activator is a chloride.

7. The process according to claim 2 wherein said container reposes in a microwave cavity wherein the composition of the gaseous atmosphere within said microwave cavity is not controlled.

8. The process according to claim 2 wherein said diffusion metal is selected from the group consisting of chromium, nickel, vanadium, boron, aluminum, iron and alloys and mixtures thereof.

9. The process according to claim 2 wherein said formed metal part is carbon steel.

10. The process according to claim 7, wherein said insulator material contains a halide activator.

11. The process according to claim 10, wherein said halide activator is a chloride.

* * * * *